US007544099B2

(12) United States Patent
Godovich

(10) Patent No.: US 7,544,099 B2
(45) Date of Patent: Jun. 9, 2009

(54) TECHNIQUES FOR PROTECTING A USER-ACCESSIBLE ELECTRICAL CONNECTOR

(76) Inventor: Mark Godovich, 19501 W. Country Club Dr., Apt. 1609, Aventura, FL (US) 33180

( * ) Notice: Subject to any disclaimer, the term of this patent is extended or adjusted under 35 U.S.C. 154(b) by 0 days.

(21) Appl. No.: 11/899,632

(22) Filed: Sep. 6, 2007

(65) Prior Publication Data

US 2009/0068892 A1 Mar. 12, 2009

(51) Int. Cl.
*H01R 25/00* (2006.01)

(52) U.S. Cl. ..... 439/641; 439/639; 439/680

(58) Field of Classification Search ..... 439/680, 439/638–639, 641
See application file for complete search history.

(56) References Cited

U.S. PATENT DOCUMENTS

| | | | | |
|---|---|---|---|---|
| 6,508,669 | B2 * | 1/2003 | Wang | 439/598 |
| 6,657,435 | B2 * | 12/2003 | Brown | 324/508 |
| 2007/0037452 | A1 * | 2/2007 | Martin et al. | 439/638 |

* cited by examiner

*Primary Examiner*—Briggitte R Hammond
*Assistant Examiner*—Vanessa Girardi
(74) *Attorney, Agent, or Firm*—Adams & Wilks

(57) ABSTRACT

A protective coupler for electrically coupling a cable terminal to a terminal of an electrical device. The protective coupler has a first portion that removably secures to a casing of the electrical device. The first portion comprises a first terminal that removably connects to the terminal of the electrical device, and a second terminal. A second portion comprises a third terminal that removably connects to the second terminal, and a fourth terminal that removably connects to the cable terminal.

17 Claims, 6 Drawing Sheets

TECHNIQUES FOR PROTECTING A USER-ACCESSIBLE ELECTRICAL CONNECTOR

BACKGROUND OF THE INVENTION

1. Field of the Invention

The present disclosure relates generally to the field of electrical connectors and, more specifically, to techniques for protecting user-accessible electrical connectors.

2. Background Information

In operation, electrical connectors and, in particular, user-accessible external electrical connectors of electronic consumer devices are often exposed to excessive forces. Such forces may damage the connectors or internal components of the device, as well as the respective cable termination. The resulting damages may be costly or irreparable and, in some instances, potentially hazardous to users of the device or environment.

There is therefore a need in the art for techniques to protect user-accessible electrical connectors of electronic consumer devices from operational damage.

SUMMARY OF THE INVENTION

Techniques for protecting user-accessible electrical connectors are described herein. In one aspect, a protective coupler is provided for electrically coupling a cable terminal to a terminal of an electrical device. The protective coupler has a first portion that removably secures to a casing of the electrical device. The first portion comprises a first terminal that removably connects to the terminal of the electrical device, and a second terminal. A second portion comprises a third terminal that removably connects to the second terminal, and a fourth terminal that removably connects to the cable terminal.

In another aspect, a method of protecting a connector of an electrical device that electrically connects to a cable terminal is provided. A first coupling portion is provided with a first terminal and a second terminal. A second coupling portion is provided with a third terminal and a fourth terminal. The first terminal is connected to the connector of the electrical device. The first coupling portion is then secured to a casing of the electrical device. Thereafter, the second terminal is connected to the third terminal and the fourth terminal is connected to the cable terminal.

In exemplary designs, the inventive techniques are used for protecting user-accessible external electrical connectors of electronic consumer devices, such as laptop computers, PDAs, cellular phones, MP3/iPOD players, and the like.

Various aspects and embodiments of the disclosure are described in further detail below.

The Summary of the Invention is neither intended nor should it be construed as being representative of the full extent and scope of the present disclosure, which these and additional aspects will become more readily apparent from the detailed description, particularly when taken together with the appended drawings.

Figure 1:
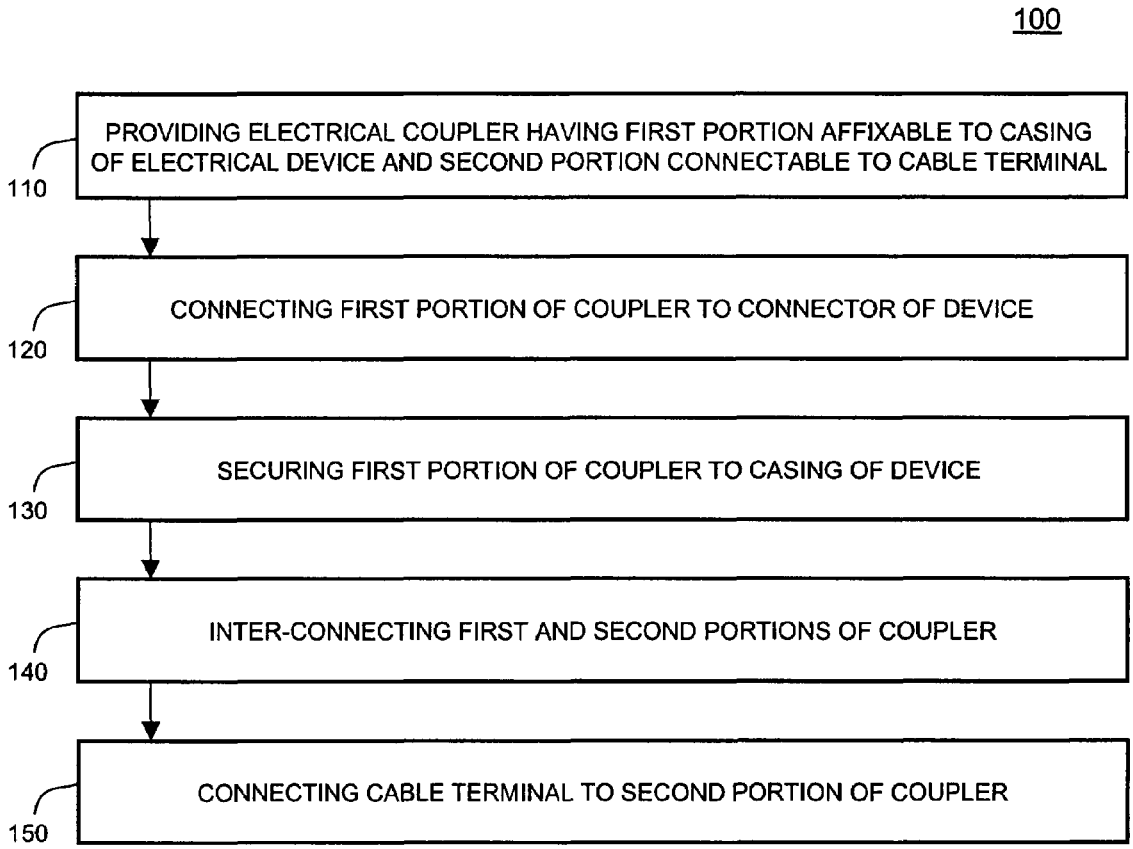
FIG. 1 is a flow diagram illustrating a method of the present disclosure for protecting a user-accessible electrical connector of an electronic device.

The images in the drawings are simplified for illustrative purposes and are not necessarily depicted to scale. To facilitate understanding, identical reference numerals have been used, where possible, to designate identical elements that are common to the figures, except that suffixes may be added, when appropriate, to differentiate such elements.

The appended drawings illustrate exemplary embodiments of the disclosure and, as such, should not be considered as limiting the scope of the disclosure that may admit to other equally effective embodiments. It is contemplated that features or steps of one embodiment may be beneficially incorporated in other embodiments without further recitation.

DETAILED DESCRIPTION OF THE PREFERRED EMBODIMENTS

The term "exemplary" is used herein to mean "serving as an example, instance, or illustration." Any embodiment or design described herein as "exemplary" or "alternative" is not necessarily to be construed as preferred or advantageous over other embodiments or designs.

Figure 2:
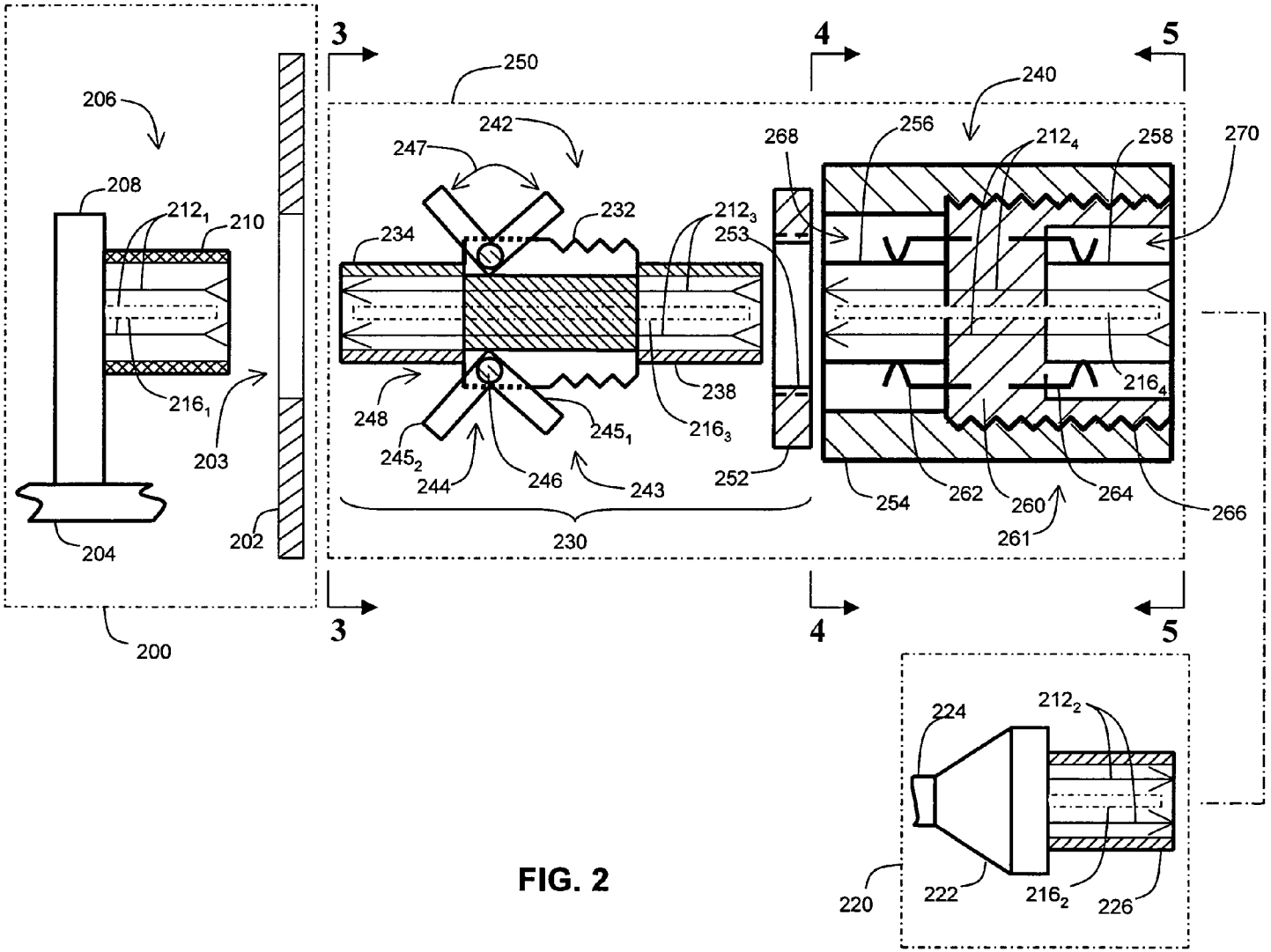
FIG. 2 is a schematic diagram illustrating, in partial cross-sectional view, an exemplary protective coupler of the present disclosure.
Figure 3:
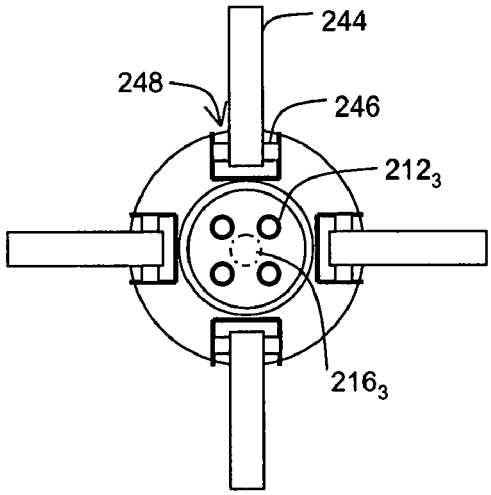
FIG. 3 is a cross-sectional view taken along line 3-3 in FIG. 2.

Referring to the drawings, FIG. 1 depicts a flow diagram illustrating a method 100 for protecting a user-accessible electrical connector of an electronic device in accordance with one embodiment of the present disclosure, and FIGS. 2-3 depict high-level schematic diagrams illustrating an exemplary embodiment of the disclosure.

The method 100 begins at step 110 where a two-portion protective coupler 250 is provided. Referring to FIG. 2, in one embodiment, the protective coupler 250 comprises a first portion 230 (hereinafter "first portion") and a second portion 240 (hereinafter "second portion") and, in operation, protects a user-accessible (i.e., external) electrical connector 206 of an electronic device 200 from damages that a mating cable termination 220 may cause to the connector 206.

Illustratively, the connector 206 is mounted on a printed circuit board 204, disposed proximate to a casing 202 of the electronic device 200, and is accessible through an opening 203 in the casing 202. Examples of such connectors 206 include AC/DC power connectors, Universal Serial BUS (USB) connectors, Firewire connectors, earphone connectors, and the like.

In the depicted embodiment, the connector 206 comprises a base 208 and a terminal (hereinafter referred to as a receptacle) 210 having at least one pin 212 (four female pins 212 are shown) and optional keying elements 216 (one keying element 216 is shown in phantom in FIG. 2 only). The cable termination 220 comprises a cable terminal (hereinafter referred to as a cable plug) 226 and a housing 222, which is coupled to a cable 224. Examples of the electronic device 200 may include laptop computers, personal digital assistants (PDAs), cellular phones, audio/video-enabled devices (for example, MP3/iPOD players, and the like), among other electronic consumer devices.

In operation (discussed in detail below with reference to FIG. 6), the first portion 230 of the coupler 250 is adapted for coupling to the receptacle 210, securing to the casing 202, and slidingly retaining the coupler's second portion 240, which is adapted for receiving and slidingly retaining the cable plug 226.

Those skilled in the art will readily appreciate that, in various embodiments of the disclosure, the connector 206 may similarly comprise a plug with male pins or a combination of male and female pins, or pins arranged in a form of a post having concentric contact areas (for example, pin arrangement used in earphone connectors, and the like), among other connector-specific features. It has been contemplated and is within the scope of the disclosure that the method 100 is utilized in the context of such connectors.

Referring again to FIG. 2, the first portion 230 of the coupler 250 includes an adapter 242 having first and second terminals (hereinafter referred to as plugs) 234, 238 and a lock nut 252 (shown detached from the adapter 242), and the second portion 240 of the coupler 250 includes third and fourth terminals (hereinafter referred to as receptacles) 256, 258. The plug 234 is adapted for connection to the receptacle 210 of the connector 206. The plug 238 and the receptable 256 are adapted for connection to one another. The receptacle 258 is adapted for connection to the cable plug 226.

More specifically, a pinout and keying configuration of the plug 234 is dimensioned to mate with a pinout and keying configuration of the receptacle 210, a pinout and keying configuration of the plug 238 is dimensioned to mate with a pinout and keying configuration of the receptacle 256, and a pinout and keying configuration of the receptacle 258 is dimensioned to mate with a pinout and keying configuration of the cable plug 226. In the depicted embodiment, the plug 238 has the same construction as the plug 234. Likewise, the receptacle 256 has the same construction as the receptacle 258. In alternate embodiments, the plug 238 and the receptacle 256 may differ in construction from the plug 234 and the receptacle 258, respectively, as well as include components (not shown) intended to enhance mechanical or electrical properties of these terminals.

Structural elements of components of the coupler 250 may be fabricated from dielectric materials such as plastics, ceramics, or combinations thereof, and may comprise mechanical enforcers made from, for example, metals or alloys.

As best shown in FIGS. 2 and 3, a center region 243 of the adapter 242 comprises at least one latch 244 and at least one longitudinal groove 248 (four latches 244 and four grooves 248 are shown), and a threaded region 232 is provided with an external thread for threading with an inner thread 253 of the lock nut 252. Each latch 244 includes side elements $\mathbf{245}_1$ and $\mathbf{245}_2$ and is rotatably disposed on a shaft 246 having ends secured to opposing sidewalls forming a respective groove 248. In one particular embodiment, the latches 244 are symmetrically disposed around a perimeter of the first portion 230. Each latch 244 may swing or pivot (as shown by arrow 247 in FIG. 6) about the shaft 246 in the directions of a longitudinal axis of the adapter 242 and is disposed at a pre-determined distance from the plug 234. In a horizontal position, at least the side element $\mathbf{245}_1$ of the latch 244 may be disposed in the groove 248.

Figure 4:
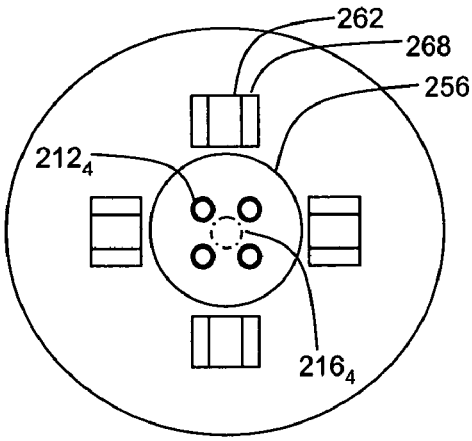
FIG. 4 is a cross-sectional view taken along line 4-4 in FIG. 2.
Figure 5:
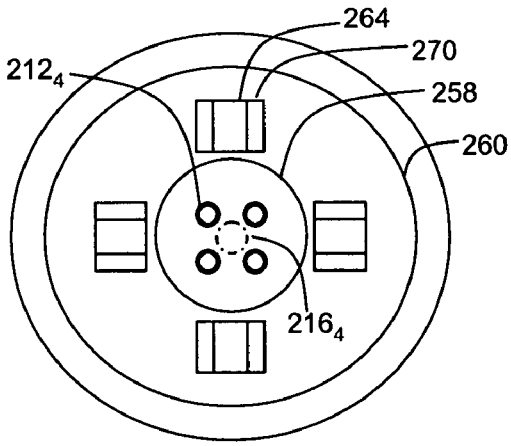
FIG. 5 is a cross-sectional view taken along line 5-5 in FIG. 2.
Figure 6:
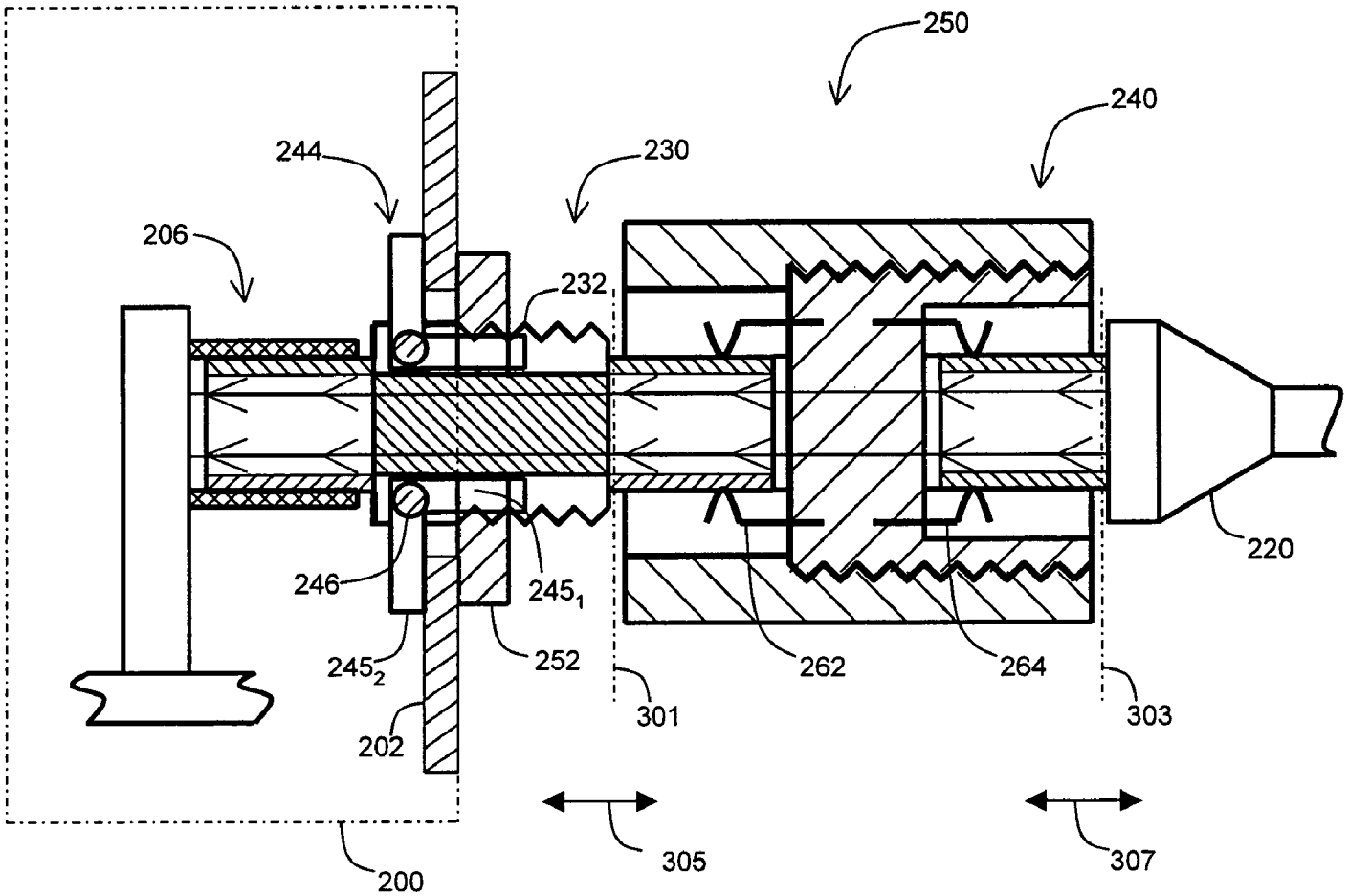
FIG. 6 is a schematic diagram illustrating, in partial cross-sectional view, an operation of the exemplary protective coupler of FIGS. 2-5.

Referring to FIGS. 2, 4 and 5, the second portion 240 of the coupler 250 includes at least one spring clip 262 and at least one spring clip 264, which are disposed in grooves 268 and 270 formed at peripheries of the receptacles 256 and 258, respectively (illustratively, four spring clip 262, 264 and four grooves 268, 270 are shown). In the fitted condition, the spring clips 262 and 264 exert pre-determined compressive forces on the plug 238 of the adapter 242 and the cable plug 226, respectively, when the plug 238 and the cable plug 226 are connected to the receptacles 256 and 258, respectively, as shown in FIG. 6 and discussed below with reference to steps 140 and 150 in FIG. 1. In one embodiment, the spring clips 262, 264 are symmetrically disposed around perimeters of the respective receptacles 256 and 258.

Illustratively, in the depicted embodiment, the spring clips 262, 264, grooves 270, pins $\mathbf{212}_4$, keying element $\mathbf{216}_4$, and receptacle 258 are portions of an insert assembly 261 further including an insert 260, which is secured to a body 254 of the second portion 240 using mating threads 266. In alternate embodiments, at least a portion of these components of the insert assembly 261 may be associated, permanently or detachably, with the body 254 or other structural elements (not shown) of the second portion 240. In another embodiment, the spring clips 262 may be portions of the spring clips 264. In further embodiments, the plug 238 and the receptacle 256 may also include optional features (not shown) directed to establishing, in the fitted state, a particular retaining force between these terminals (for example, pre-determined pin or keying configurations, and the like).

At step 120, the plug 234 of the first portion 230 is coupled by a user to the receptacle 210 of the electrical connector 206 in a state (not shown) when the side elements $\mathbf{245}_1$ of the latches 244 are disposed horizontally and the side elements $\mathbf{245}_2$ of the latches 244 are disposed vertically, as shown in the assembled configuration of FIG. 6.

With reference to FIG. 6, at step 130 the side elements $\mathbf{245}_2$ are rotated, in coordination, inside the device 200 (i.e., behind the casing 202) into the vertical positions and, as such, the side elements $\mathbf{245}_1$ become disposed horizontally in the respective grooves 248. In this state of the latches 244, the lock nut 252 is driven, by the user, over the threaded region 232 of the adapter 242 and tightened against the casing 202. As a result, the casing 202 is compressed between the latches 244 and the lock nut 252 and, as such, the first portion 230 becomes secured (i.e., affixed) to the casing 202 of the electronic device 200.

At step 140, the first and second portions 230, 240 of the coupler 250 are interconnected. Referring to FIGS. 2 and 6, the plug 238 is received by the receptacle 256, where the plug 238 is slidingly retained, with a pre-determined force, by the spring clips 262 and mating components of the plug and receptacle, such as pins $\mathbf{212}_3/\mathbf{212}_4$ or keying elements $\mathbf{216}_3/\mathbf{216}_4$.

At step 150, the cable termination 220 is coupled, or fitted, to the second portion 240 of the coupler 250. In particular, the cable plug 226 is connected to the receptacle 258, at which point the cable plug 226 is slidingly retained, with a pre-determined force, by the spring clips 264 and mating components of the plug and receptacle, such as pins $\mathbf{212}_2/\mathbf{212}_4$ or keying elements $\mathbf{216}_2/\mathbf{216}_4$.

In operation, when excessive forces are applied to the cable termination 220 and/or the electronic device 200, the portions 230 and 240 of the coupler 250 or the portion 240 and the cable termination 220 may be slidingly detached (illustrated by arrows 305 and 307 in FIG. 6) from one another along break lines 301 or 303 shown in FIG. 6, thus protecting the connector 206, internal elements of the electronic device 200, and/or the cable termination 220 from being damaged by such excessive forces.

Specifically, the excessive forces may cause the plug 238 to be disconnected from the receptacle 256 or the cable plug 226 to be disconnected from the receptacle 258, as well as may cause both plugs 238 and 226 to be disconnected from the receptacles 256 and 258, as defined by the pre-determined retaining forces (as discussed for steps 140 and 150 in FIG. 1) developed between the respective fitted terminals.

Figure 7:
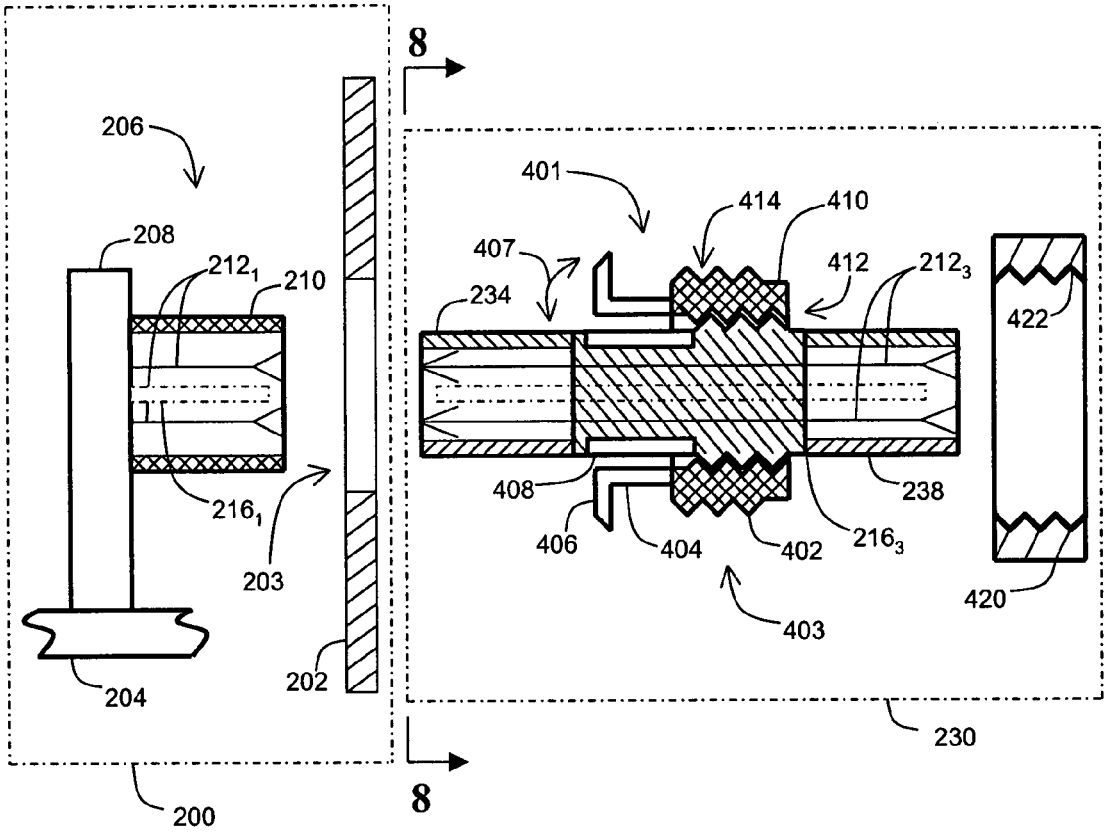
FIG. 7 is a schematic diagram illustrating, in partial cross-sectional view, an alternate embodiment of the protective coupler of the present disclosure.
Figure 8:
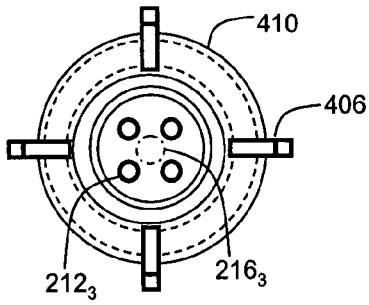
FIG. 8 is a cross-sectional view taken along line 8-8 in FIG. 7.
Figure 9:
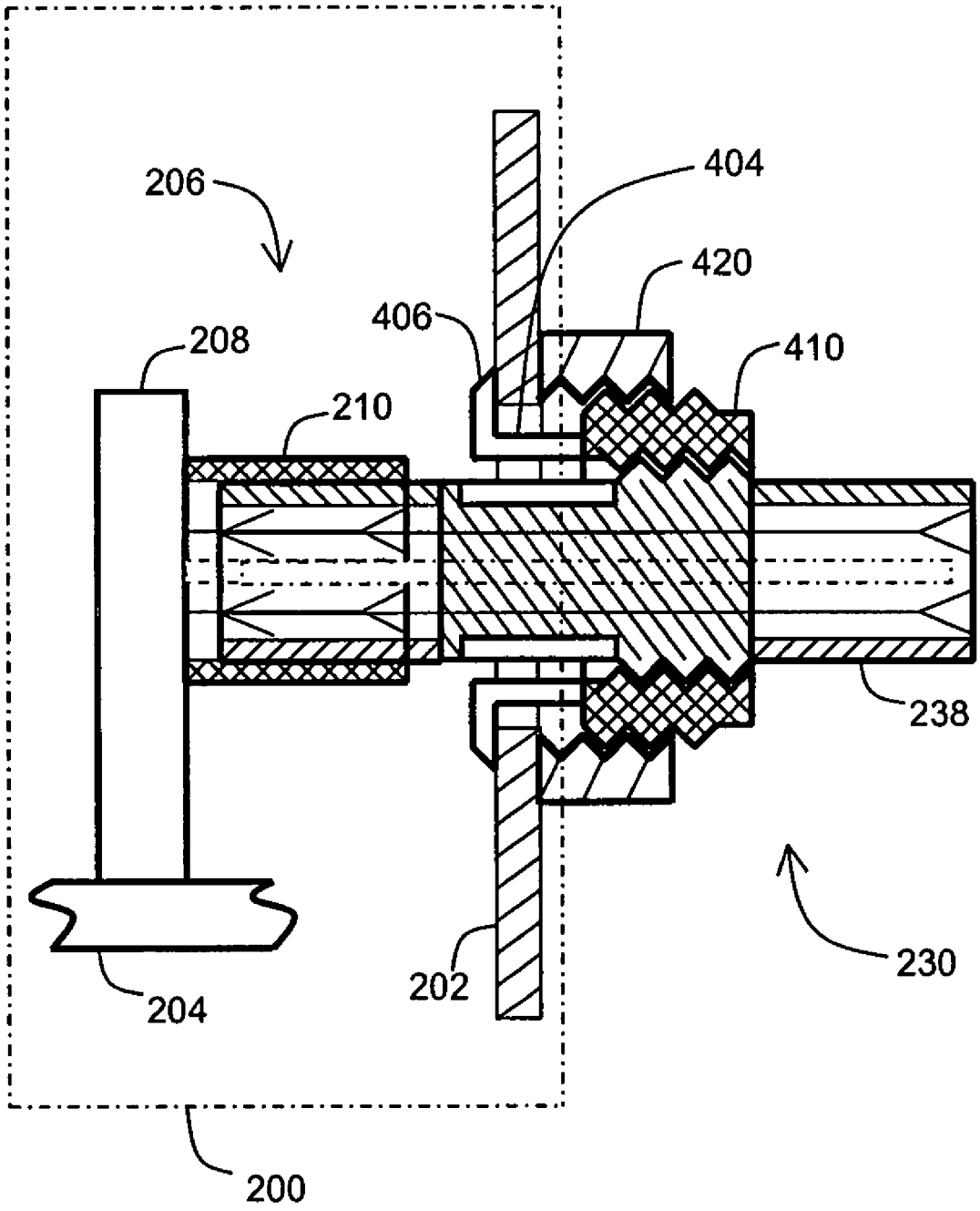
FIG. 9 is a schematic diagram illustrating, in partial cross-sectional view, an operation of the exemplary protective coupler of FIGS. 7-8.

FIGS. 7-9 show an alternate embodiment of the protective coupler of the present disclosure. The alternate embodiment differs from the embodiment of FIGS. 2-6 only in the structure of the first portion 230 of the protective coupler 250. The second portion 240 of the protective coupler and its manner of connection to the first portion 230 and the cable termination 220 are as described above for the embodiment of FIGS. 2-6. Accordingly, a description of the structure and connection of the second portion 240 is omitted.

In the alternate embodiment shown in FIGS. 7-9, the first portion 230 of the protective coupler 250 includes an adapter 401 having terminals (plugs) 234 and 238, a latch ring 410, and a lock nut 420 (shown detached from the adapter 401). Using a helical coupling 412, the latch ring 410 is rotatably secured to the adapter 401 at a pre-determined distance from the plug 234.

The latch ring 410 has at least one spring latch 404 (for example, four spring latches 404) that is flexibly coupled to or is an extension of the latch ring 410 and comprises an externally threaded region 414 having an external thread 402 for threading with an internal thread 422 of the lock nut 420. The spring latch 404 is adapted for reversible deflections towards the terminal 234 as shown by arrow 407 in FIG. 7 and is provided with a retaining hook 406. In the depicted embodiment, the adapter 401 includes optional grooves 408, which are adapted for receiving the deflected portions of the respective spring latches 404.

In operation, at step 120, when the plug 234 is coupled to the receptacle 210, the retaining hooks 406 snappably fasten to the casing 202, as depicted in FIG. 9. Then, when at step 130 the lock nut 420 is driven, by the user, over the thread region 414 (i.e., when the internal thread 422 of the lock nut 420 is threaded with the external thread 402 of the latch ring 410) and tightened against the casing 202, the casing 202 is compressed between the retaining hooks 406 and the lock nut 420. As a result, the first portion 230 becomes secured to the casing 202 of the electronic device 200.

In alternate embodiments, additionally or alternatively, the protective coupler 250 may comprise other means adapted for securing the first portion 230 to the casing 202 of the electronic device 200, including mechanical means, magnetic means, adhesive means, vacuum-producing means, or a combination thereof.

The foregoing description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

What is claimed is:

1. A protective coupler for electrically coupling a cable terminal to a terminal of an electrical device, the protective coupler comprising:

a first portion that removably secures to a casing of the electrical device, the first portion comprising a first terminal that removably connects to the terminal of the electrical device, and a second terminal;

a latch ring rotatably secured to the first portion at a predetermined distance from the first terminal, the latch ring having an external thread and at least one spring latch provided with a retaining hook adapted for reversible deflections towards the first terminal;

a lock nut having an internal thread for threading with the external thread of the latch ring; and a second portion comprising a third terminal that removably connects to the second terminal, and a fourth terminal that removably connects to the cable terminal.

2. A protective coupler according to claim 1; wherein the first terminal has a pinout and keying configuration dimensioned to mate with a pinout and keying configuration of the terminal of the electrical device; wherein the fourth terminal has a pinout and keying configuration dimensioned to mate with a pinout and keying configuration of the cable terminal; and wherein the second terminal has a pinout and keying configuration dimensioned to mate with a pinout and keying configuration of the third terminal.

3. A protective coupler according to claim 1; wherein the first portion further comprises grooves selectively adapted for receiving deflected portions of the at least one spring latch.

4. A protective coupler according to claim 1; wherein when the first terminal is removably connected to the terminal of the electrical device, the at least one spring latch is fastened to the casing of the electrical device and compresses a portion of the casing between the retaining hook of the at least one spring latch and the lock nut.

5. A protective coupler for electrically coupling a cable terminal to a terminal of an electrical device, the protective coupler comprising:

a first portion that removably secures to a casing of the electrical device, the first portion comprising a first terminal that removably connects to the terminal of the electrical device, and a second terminal; and a second portion comprising a third terminal that removably connects to the second terminal, a fourth terminal that removably connects to the cable terminal, at least one first spring clip adapted to exert a first predetermined compressive force on the second terminal, and at least one second spring clip adapted to exert a second predetermined compressive force on the cable terminal.

6. A protective coupler according to claim 1; wherein the terminal of the electrical device comprises a connector selected from the group consisting of an AC/DC power connector, an Universal Serial BUS (USB) connector, a Firewire connector, and an earphone connector.

7. A protective coupler according to claim 1; wherein the electrical device is selected from the group consisting of a laptop computer, a personal digital assistant (PDA), a cellular phone, and an audio/video-enabled device.

8. A protective coupler according to claim 1; further comprising at least one of mechanical means, magnetic means, adhesive means, and vacuum-producing means, or a combination thereof, for removably securing the first portion to the casing of the electrical device.

9. A protective coupler according to claim 5; wherein the at least one first spring clip is a portion of the at least one second spring clip.

10. A protective coupler according to claim 5; wherein the at least one first spring clip or the at least one second spring clip is detachably coupled to a body of the second terminal.

11. A protective coupler comprising:

a first portion comprised of a first terminal, a second terminal opposite to the first terminal, a threaded region disposed between the first and second terminals, and at least one latch mounted to undergo pivotal movement and disposed between the threaded region and the first terminal; and a second portion comprised of a third terminal that removably connects to the second terminal, a fourth terminal opposite to the third terminal, and at least one spring clip adapted to exert a predetermined compressive force on the second terminal.

12. A protective coupler according to claim 11; wherein the first portion further comprises a lock nut having a thread for threading with the threaded region.

13. A protective coupler according to claim 11; wherein the at least one latch comprises a plurality of latches symmetrically disposed around a perimeter of the first portion.

14. A protective coupler according to claim 11; wherein the at least one latch has a first side element and a second side element coupled substantially orthogonal to the first side element.

15. A protective coupler according to claim 14; wherein the first portion further comprises grooves for housing at least the second side element of the at least one latch.

16. A method of protecting a connector of an electrical device that electrically connects to a cable terminal, comprising:

providing a first coupling portion having a first terminal and a second terminal;

providing a second coupling portion having a third terminal and a fourth terminal;

connecting the first terminal to a connector of an electrical device;

securing the first coupling portion to a casing of the electrical device;

connecting the second terminal to the third terminal; and connecting the fourth terminal to a cable terminal;

wherein the step of providing the first coupling portion further comprises the step of providing a lock nut having a thread and latch ring rotatably secured to the first coupling portion and having (i) at least one spring latch provided with a retaining hook adapted for reversible deflections towards the first terminal and (ii) a threaded peripheral region for threaded engagement with the thread of the lock nut; and wherein the securing step comprises securing the first coupling portion to the casing of the electronic device by coupling to the casing the retaining hook of the at least one spring latch and compressing a portion of the casing between the retaining hook and the lock nut by threading the thread of the lock nut with the threaded peripheral region of the latch ring.

17. A protective coupler according to claim 1; wherein the at least one spring latch comprises a plurality of spring latches symmetrically disposed around a perimeter of the first portion.

* * * * *